US009013957B2

(12) United States Patent
Vecseri et al.

(10) Patent No.: US 9,013,957 B2
(45) Date of Patent: Apr. 21, 2015

(54) FULL FLOW PULSER FOR MEASUREMENT WHILE DRILLING (MWD) DEVICE

(75) Inventors: Gabor Vecseri, Houston, TX (US); Benjamin Jennings, Houston, TX (US)

(73) Assignee: Teledrill, Inc., Allentown, PA (US)

( * ) Notice: Subject to any disclaimer, the term of this patent is extended or adjusted under 35 U.S.C. 154(b) by 668 days.

(21) Appl. No.: 13/368,150

(22) Filed: Feb. 7, 2012

(65) Prior Publication Data

US 2013/0051177 A1 Feb. 28, 2013

Related U.S. Application Data

(63) Continuation of application No. 13/336,981, filed on Dec. 23, 2011.

(60) Provisional application No. 61/529,329, filed on Aug. 31, 2011.

(51) Int. Cl.
*E21B 47/16* (2006.01)
*E21B 4/02* (2006.01)
(Continued)

(52) U.S. Cl.
CPC . *E21B 4/02* (2013.01); *E21B 47/18* (2013.01); *E21B 17/20* (2013.01)

(58) Field of Classification Search
CPC ..... E21B 47/16; E21B 47/14; E21B 47/18; E21B 47/12; E21B 47/011; E21B 47/122; G01V 11/002; G01V 1/40; G01V 1/50; G01V 1/44; G01V 1/46
USPC ..... 367/81–84; 340/853.4–853.6, 855.4, 340/870.19–870.25
See application file for complete search history.

(56) References Cited

U.S. PATENT DOCUMENTS 2,397,070 A 3/1946 Zublin
2,797,893 A 7/1957 McCune et al.
(Continued)

FOREIGN PATENT DOCUMENTS

EP 0681090 A2 11/1995
WO 2010071621 A1 6/2010

OTHER PUBLICATIONS

C. G. Blount; M. B. Mooney; F. R. Behenna; R. K. Stephens; R. D. Smith, Well-Intervention Challenges to Service Wells That "Can Be Drilled", Society of Petroleum Engineers, 2006, 1-12, SPE 100172, US.

(Continued)

*Primary Examiner* — George Bugg
*Assistant Examiner* — Sharmin Akhter
(74) *Attorney, Agent, or Firm* — Guerry L. Grune; ePatentManager.com

(57) ABSTRACT

An apparatus, method, and system described for generating pressure pulses in a drilling fluid utilizing a flow throttling device longitudinally and axially positioned within the center of a main valve actuator assembly is described. The main valve actuator assembly includes a main valve pressure chamber, a magnetic cup encompassing a rotary magnetic coupling, and a pilot actuator assembly. Passage of drilling fluid through a series of orifices, valves, shields, and screens where the fluid eventually combines with a pilot exit fluid that flows toward a main exit flow such that as the fluid becomes a pilot fluid that ultimately combines with the main flow such that the combined fluid causes one or more flow throttling devices to generate large, rapid controllable pulses that produce transmission of well developed signals easily distinguished from other noise resulting from other vibrations due to nearby equipment that is within or exterior to the borehole such that the signals also provide predetermined height, width and shape.

47 Claims, 4 Drawing Sheets

(51) Int. Cl.
*E21B 47/18* (2012.01)
*E21B 17/20* (2006.01)

(56) References Cited

U.S. PATENT DOCUMENTS

| | | | | |
|---|---|---|---|---|
| 2,858,107 | A | 10/1958 | Colmerauer | |
| 3,958,217 | A | 5/1976 | Spinnler | |
| 4,436,165 | A | 3/1984 | Emery | |
| 4,807,704 | A | 2/1989 | Hsu et al. | |
| 4,901,290 | A | 2/1990 | Feld et al. | |
| 5,009,272 | A | 4/1991 | Walter | |
| 5,040,155 | A | 8/1991 | Feld | |
| 5,103,430 | A * | 4/1992 | Jeter et al. | 367/85 |
| 5,190,114 | A | 3/1993 | Walter | |
| 5,508,975 | A | 4/1996 | Walter | |
| 5,626,016 | A | 5/1997 | Walter | |
| 5,660,238 | A * | 8/1997 | Earl et al. | 175/40 |
| 6,053,261 | A | 4/2000 | Walter | |
| 6,082,473 | A | 7/2000 | Dickey | |
| 6,102,138 | A | 8/2000 | Fincher | |
| 6,237,701 | B1 | 5/2001 | Kolle et al. | |
| 6,279,670 | B1 | 8/2001 | Eddison et al. | |
| 6,338,390 | B1 | 1/2002 | Tibbitts | |
| 6,439,316 | B1 | 8/2002 | Penisson | |
| 6,508,317 | B2 | 1/2003 | Eddison et al. | |
| 6,588,518 | B2 | 7/2003 | Eddison | |
| 6,668,948 | B2 | 12/2003 | Buckman et al. | |
| 6,840,337 | B2 | 1/2005 | Terry et al. | |
| 6,850,463 | B2 * | 2/2005 | Winnacker | 367/83 |
| 6,997,272 | B2 | 2/2006 | Eppink | |
| 7,011,156 | B2 | 3/2006 | von Gynz-Rekowski | |
| 7,032,689 | B2 | 4/2006 | Goldman et al. | |
| 7,051,821 | B2 | 5/2006 | Samuel | |
| 7,100,708 | B2 | 9/2006 | Koederitz | |
| 7,139,219 | B2 | 11/2006 | Kolle et al. | |
| 7,180,826 | B2 | 2/2007 | Kusko | |
| 7,417,920 | B2 * | 8/2008 | Hahn et al. | 367/85 |
| 7,958,952 | B2 | 6/2011 | Kusko et al. | |
| 2006/0072374 | A1 | 4/2006 | Kusko | |
| 2008/0179093 | A1 | 7/2008 | Kusko | |
| 2008/0271923 | A1 | 11/2008 | Kusko | |
| 2009/0107723 | A1 | 4/2009 | Kusko | |
| 2009/0114396 | A1 | 5/2009 | Kusko | |
| 2010/0147525 | A1 | 6/2010 | Lerner | |
| 2010/0157735 | A1 * | 6/2010 | Allan et al. | 367/84 |

OTHER PUBLICATIONS

G. Mensa-Wilmot; Y. Harjadi; S. Langdon;J. Gagneaux, SPE, Chevron Corp., Drilling Efficiency and Rate of Penetration—Definitions, Influencing Factors, Relationships and Value, IADC/SPE, 2010, 1-13, IADC/SPE 128288, US.

J. Castaneda; C. E. Schneider; D. Brunskill, Coiled Tubing Milling Operations: Successful Application of an Innovative Variable-Water Hammer Extended-Reach BHA to Improve End Load Efficiencies of a PDM in Horizontal Wells, Society of Petroleum Engineers, 2011, 1-19, SPE 143346, US.

K. Mazerov, Coiled Tubing Pushing its Limits by Going Bigger, Expanding Niche applications, Thinking Riserless, www.DrillingContractor.org, 2011, 1-3, US.

International Coiled Tubing Association, An Introduction to Coiled Tubing: History, Applications and Benefits, ICoTA, 2005, 1-28, US.

* cited by examiner

FULL FLOW PULSER FOR MEASUREMENT WHILE DRILLING (MWD) DEVICE

PRIORITY STATEMENT

This application takes priority from U.S. Provisional Application 61/529,329 filed on Aug. 31, 2011, entitled "Full Flow Pulser for Measurement While Drilling (MWD) Device" and U.S. Nonprovisional application Ser. No. 13/336,981 filed on Dec. 23, 2011 and entitled "Controlled Pressure Pulser for Coiled Tubing Applications", of which this application is a continuation. The entire contents of both applications are hereby incorporated by reference.

FIELD OF DISCLOSURE

The current invention includes an apparatus and a method for creating a pulse within the drilling fluid, generally known as drilling mud, that is generated by selectively initiating flow driven bidirectional pulses. Features of the device include operating a flow throttling device [FTD] that operates without a centrally located valve guide within a newly designed annular flow channel providing more open area to the flow of the drilling fluid in a measurement-while-drilling device to provide for reproducible pressure pulses that are translated into low noise signals. The pulse is then received "up hole" as a series of pressure variations that represent pressure signals which may be interpreted as inclination, azimuth, gamma ray counts per second, etc. by oilfield engineers and managers and utilized to increase yield in oilfield operations.

BACKGROUND

Current pulser technology utilizes pulsers that are sensitive to different fluid pump down hole pressures, and flow rates, and require field adjustments to pulse properly so that meaningful signals from these pulses can be received and interpreted uphole.

An important advantage of the present disclosure and the associated embodiments is that it decreases sensitivity to fluid flow rate or pressure within easily achievable limits, does not require field adjustment, and is capable of creating recognizable, repeatable, reproducible, clean [i.e. noise free] fluid pulse signals using minimum power due to a unique flow throttling device [FTD] with a pulser that requires no guide, guide pole or other guidance system to operate the main valve, thus reducing wear, clogging and capital investment of unnecessary equipment as well as increasing longevity and dependability in the down hole portion of the MWD tool. This MWD tool still utilizes battery, magneto-electric and/or turbine generated energy. The mostly unobstructed main flow in the main flow area enters into the cone without altering the main flow pattern. Without the mudscreen obstructing the main flow area there is no reduction in the differential pressure so that the original orifice opening (area and volume) and the cone geometry (area and volume) causes a restriction in flow leading to a large differential in flow rate leading to a larger associated pressure differential (as described in the Bernoulli equation). The increased flow rate and change in pressure produces a very efficient pilot valve response and associated energy pulses. Specifically, as the pilot valve closes faster (than in any known previous designs) this produces a water hammer effect much like that is heard when shutting off a water faucet extremely quickly. The faster flow and corresponding larger pressure differential also moves the pilot valve into an open and closed position more rapidly. The faster the closure, the more pronounced the water hammer effect and the larger the pulse and associated measured spike associated with the pulse. These high energy pulses are also attributed to the position and integrity of the pilot channel seals (240) which ensure rapid and complete closure while maintaining complete stoppage of flow through the channel. The controllability of the pulser is also significantly enhanced in that the shape of the pressure wave generated by the energy pulse can be more precisely predetermined. The pulse rise and fall time is sharp and swift—much more so than with conventional devices utilizing guide pole designs. These more easily controlled and better defined energy pulses are easily distinguished from the background noise associated with MWD tools. Distinguishing from the "background" noise leading to ease of decoding signals occurring on an oil or gas rig offers tremendous advantages over current tools. Being able to control and determine pulse size, location, and shape without ambiguity provides the user with reproducible, reliable data that results in reduced time on the rig for analysis and more reliable and efficient drilling. It is estimated that each work day on a rig, on average, amounts to more than 1 million US dollars, so that each hour saved has extreme value.

SUMMARY

The present disclosure involves the placement of a Measurement-While-Drilling (MWD) pulser device including a flow throttling device located within a drill collar in a wellbore incorporating drilling fluids for directional and intelligent drilling. In the design, the pilot channel location is very different than in any prior application in that the channel is now located on the outside annulus. The present invention discloses a novel device for creating pulses in drilling fluid media flowing through a drill string. Past devices, currently in use, require springs or solenoids to assist in creating pulses and are primarily located in the main drilling fluid flow channel. U.S. Pat. No. 7,180,826 and US Application Number 2007/0104030A1 to Kusko, et. al., the contents of which are completely and hereby fully incorporated by reference, disclose a fully functional pulser system that requires the use of a pulser guide pole to guide and define the movement of the main valve together with a different hydraulic channel designs than that of the present application and associated invention. The pilot flow for the present invention without the guide pole allows for more efficient repair and maintenance processes and also allows for quickly replacing the newly designed apparatus of the present disclosure on the well site as there is at least a 15-20 percent reduction in capital costs and the costs on the maintenance side are drastically reduced. In the previous designs, guide pole failures accounted for 60-70 percent of the downhole problems associated with the older versions of the MWD. With the guide pole elimination, reliability and longer term down hole usage increases substantially, providing a more robust tool and much more desirable MWD experience.

Additionally, previous devices also required onsite adjustment of the flow throttling device (FTD) pulser according to the flow volume and fluid pressure and require higher energy consumption due to resistance of the fluid flow as it flows through an opened and throttled position in the drill collar.

The elimination of the centralized guide pole and pilot channel allows in the current design larger pressure differential to be created between the pilot flow and the main flow at the main valve thus increasing the control and calibration and operation of the pulser. The ability to precisely control the pulser and thus the pressure pulse signals is directly related to cleaner, more distinguishable and more defined signals that can be easier detected and decoded up hole.

The device provided by the current invention allows for the use of a flow throttling device that moves from an initial position to an intermediate and final position in both the upward and downward direction corresponding to the direction of the fluid flow. The present invention still avoids the use of springs, the use of which are described in the following patents which are also herewith incorporated by reference as presented in U.S. Pat. Nos. 3,958,217, 4,901,290, and 5,040,155.

DETAILED DESCRIPTION OF THE DRAWINGS

Figure 1:
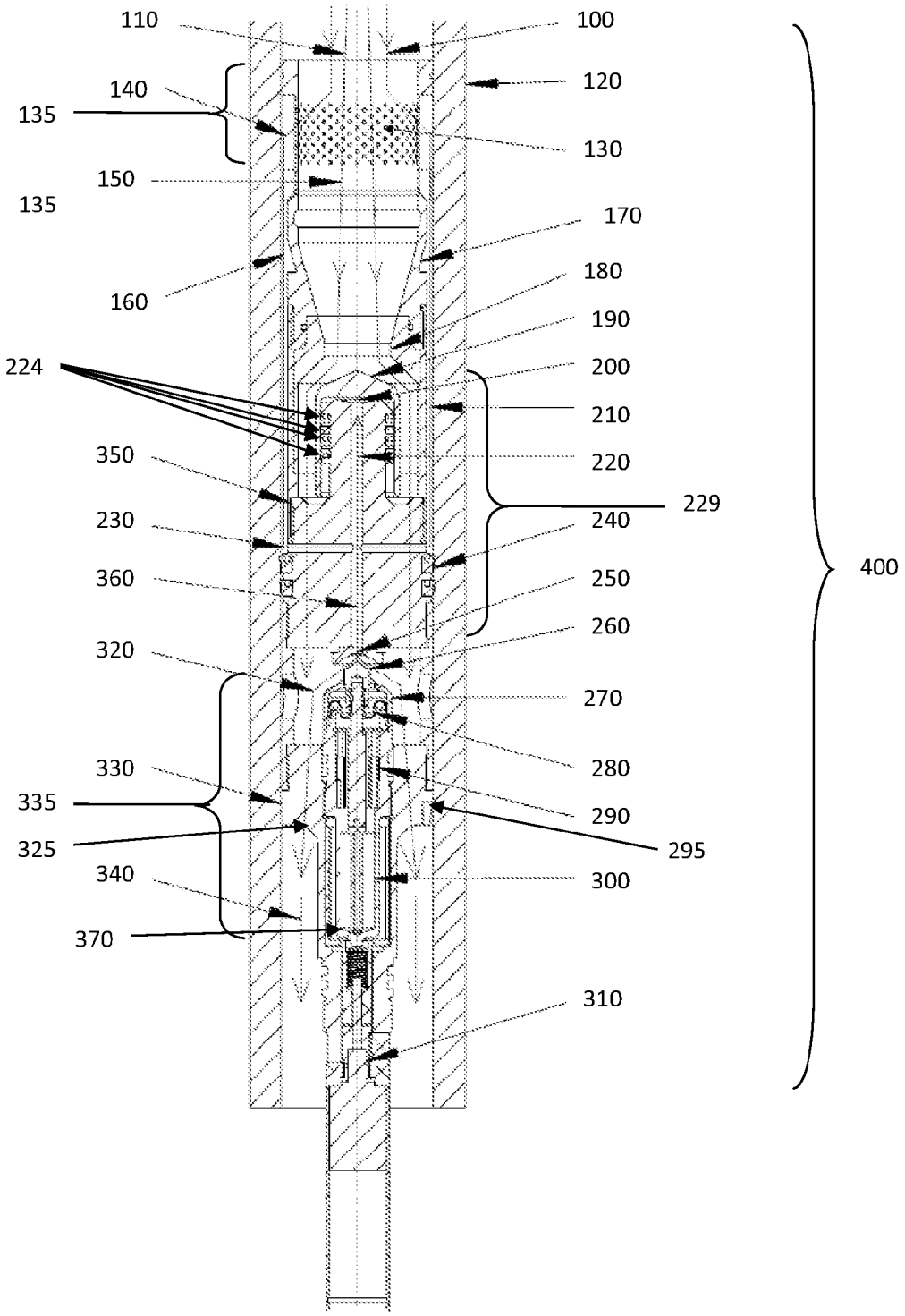
FIG. 1 is an overview of at the full flow MWD.

With reference now to FIG. 1, the pulser assembly [400] device illustrated produces pressure pulses in drilling fluid main flow [110] flowing through a tubular hang-off collar [120] and includes a pilot flow upper annulus [160]. The flow cone [170] is secured to the inner diameter of the hang off collar [120]. Major assemblies of the MWD are shown as provided including aligned within the bore hole the pilot flow screen assembly [135] and main valve actuator assembly [229] and pilot actuator assembly [335].

In FIG. 1, starting from an outside position and moving toward the center of the main valve actuator assembly [226] comprising a main valve [190], a main valve pressure chamber [200], a main valve support block [350], main valve seals [ 225] and flow guide seal [240]. The same figure shows the main valve feed channel [220], the pilot orifice [250], pilot valve [260], pilot flow shield [270], bellows [280] and the anti-rotation block [290], as well as a cylindrical support shoulder [325] and tool face alignment key [295] that exists below the pilot flow shield for keeping the pulser assembly centered within the bore hole. This figure also shows the passage of the main flow [110] past the pilot flow screen [130] through the main flow entrance [150], into the flow cone [170], through the main orifice [180] into and around the main valve [190], past the main valve pressure chamber [200], past the main valve seals [225] through the main valve support block [350], after which it combines with the pilot exit flow [320] to become the main exit flow [340]. The pilot flow [100] flows through the pilot flow screen [130] into the pilot flow screen chamber [140], through the pilot flow upper annulus [160], through the pilot flow lower annulus [210] and into the pilot flow inlet channel [230], where it then flows up into the main valve feed channel [220] until it reaches the main valve pressure chamber [200] where it flows back down the main valve feed channel [220], through the pilot flow exit channel [360], through the pilot orifice [250], past the pilot valve [260] where the pilot exit flow [320] flows over the pilot flow shield [270] where it combines with the main flow [110] to become the main exit flow [340] as it exits the pilot valve support block [330] and flows on either side of the rotary magnetic coupling [300], past the drive shaft and the motor [310].

The pilot actuator assembly [335] includes a magnetic pressure cup [370], and encompasses the rotary magnetic coupling [300]. The magnetic pressure cup [370] and the rotary magnetic coupling [300] may comprise several magnets, or one or more components of magnetic or ceramic material exhibiting several magnetic poles within a single component. The magnets are located and positioned in such a manner that the rotary movement or the magnetic pressure cup [370] linearly and axially moves the pilot valve [260]. The rotary magnetic coupling [300] is actuated by the adjacent drive shaft [305].

Figure 2:
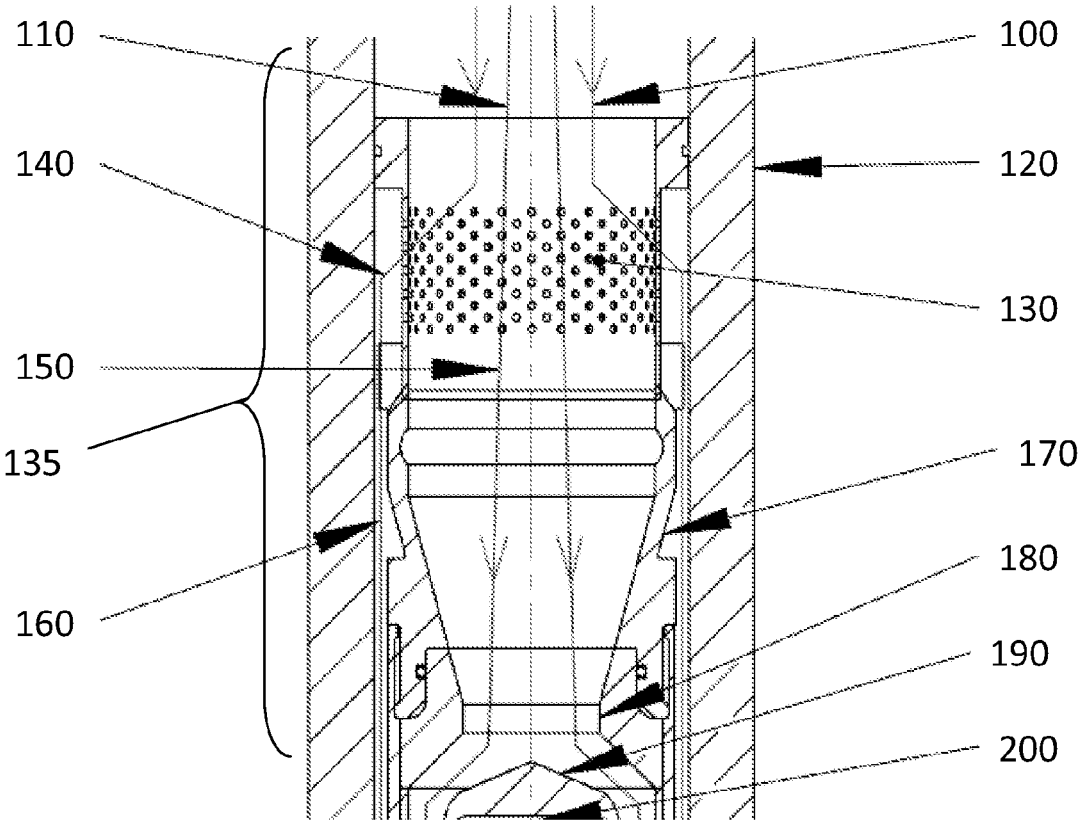
FIG. 2 is a close up of the pilot flow screen assembly

FIG. 2 provides details of the pulser assembly in the open position; the pilot flow [100] and main flow [110] both flow through the pilot flow screen assembly [135] and pilot flow screen [130] where a portion of the main flow [110] flows through the pilot flow screen [130]. The pilot flow [100] flows through the pilot flow screen chamber [140] and into the pilot flow upper annulus [160]. Pilot flow [100] and main flow [110] within the pilot flow screen assembly [135] flows through the main flow entrance [150] and through the flow cone [170] and into the main orifice [180] to allow for flow within the main valve feed channel [220].

Figure 3:
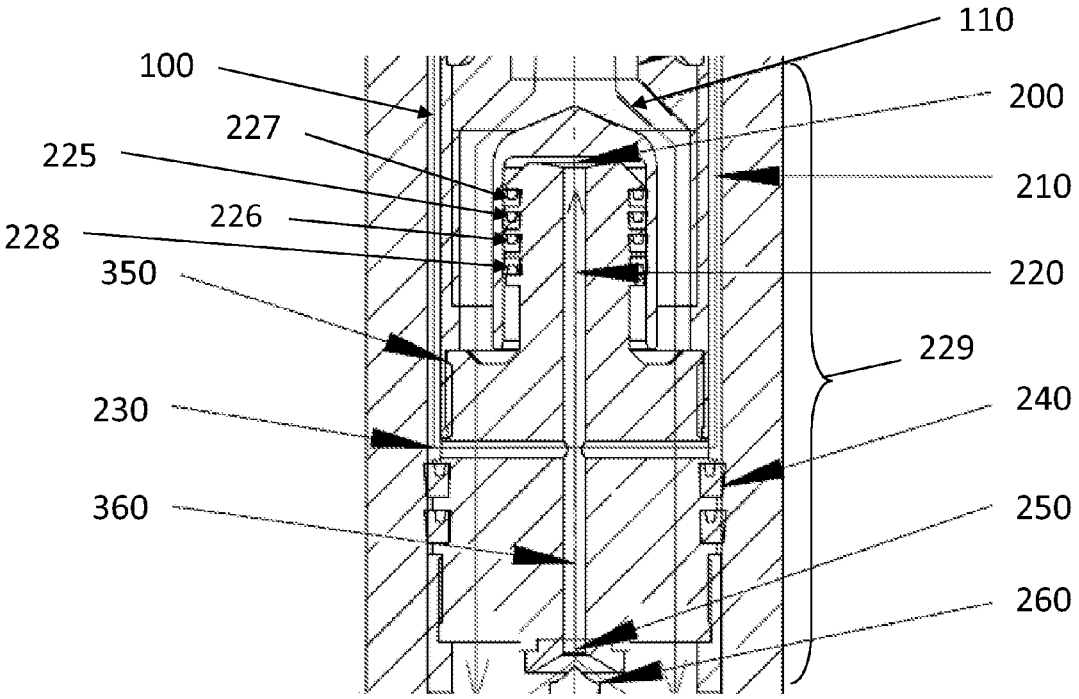
FIG. 3 is a detailed cross section of the main valve actuator assembly including the seals.

FIG. 3 describes the main valve actuator assembly [229] and illustrates the flow of the pilot flow [100] and main flow [110] areas with the main valve [190] in open position. The main flow [110] passes through openings in the main valve support block [350] while the pilot flow [100] flows through the pilot flow lower annulus [210], into the pilot flow inlet channel [230] and into the main valve feed channel [220] which puts pressure on the main valve pressure chamber [200] when the pilot valve [260] is in closed position. The pilot flow [100] then flows out through the pilot flow exit channel [360], through the pilot orifice [250] and over the pilot valve [260]. Also shown are the seals [225, 226, 227, 228 &240] of the main valve actuator assembly.

When pilot valve [260] closes, pressure increases through the main valve feed channel [220] into the main valve pressure chamber [200]. The upper outer seal [227], upper inner seal [225], lower inner seal [226], lower outer seal [228] and flow guide seal [240] keep the pilot flow [100] pressure constrained and equal to the pressure that exists in main flow entrance [150] area.

Upper outer seal [227] and lower outer seal [228] exclude large particulates from entering into the space where the upper inner seal [225] and lower inner seal [226] reside. The upper outer seal [227] and lower outer seal [228] do not support a pressure load and allow a small amount of pilot flow [100] to bypass while excluding particulates from entering the area around the upper inner seal [225] and lower inner seal [226]. This eliminates pressure locking between the inner seals [225, 226] and the outer seals [227, 228]. By excluding the particulates from entering into the space where the inner seals reside [225, 226] the seals are protected and the clearances of the inner seals [225, 226] can be reduced to support high pressure loads. Very small particulates can bypass the outer seals [227, 228], but the particulates must be very small in relative to the clearances of the inner seals [225, 226] to penetrate the space between the outer seals [227, 228] and inner seals [225, 226].

Figure 4:
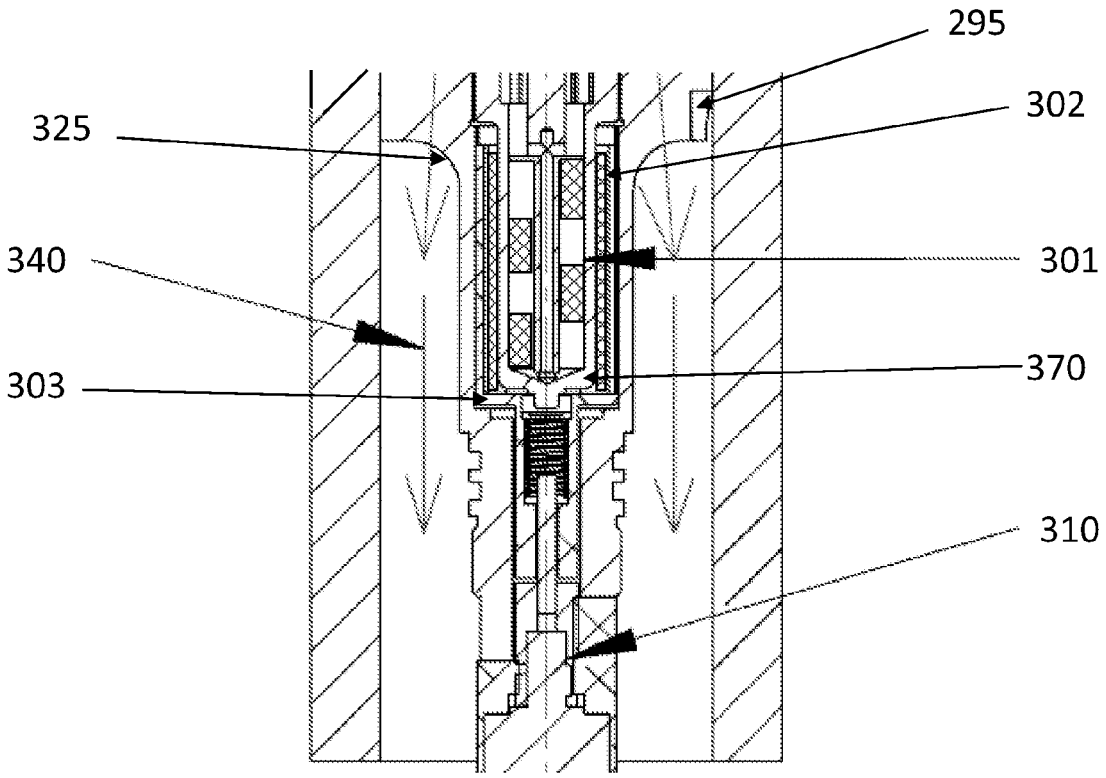
FIG. 4 shows the lower portion of the pilot actuator assembly, drive shaft and motor.

Referring to FIG. 4, an embodiment of the rotary magnetic coupling [300] and motor [310] is shown. The Main exit flow [340] flows parallel along each side of the rotary magnetic coupling [300] which is contained within the magnetic pressure cup [370], past the drive shaft and parallel along each side of the motor [310] down toward the cylindrical support shoulder [325] that includes a tool face alignment key [295] below the pilot flow shield [270]. The magnetic pressure cup [370] is comprised of a non-magnetic material, and is encompassed by the outer magnets [302]. The outer magnets [302] may comprise several magnets, or one or more components of magnetic or ceramic material exhibiting several magnetic poles within a single component. The outer magnets [302] are housed in an outer magnet housing [303] that is attached to the drive shaft. Within the magnetic pressure cup [370] are housed the inner magnets [301] which are permanently connected to the pilot valve [260].

The outer magnets [302] and the inner magnets [301] are placed so that the magnetic polar regions interact, attracting and repelling as the outer magnets [302] are moved about the inner magnets [301] The relational combination of magnetic poles of the moving outer magnets [302] and inner magnets [301], causes the inner magnets [301] to move the pilot valve [260] linearly and interactively without rotating. The use of outer magnets [302] and inner magnets [301] to provide movement from rotational motion to linear motion also allows the motor [310] to be located in an air atmospheric environment in lieu of a lubricating fluid environment. This also allows for a decrease in the cost of the motor [310], decreased energy consumption and subsequently decreased cost of the actual MWD device. It also alleviates the possibility of flooding the sensor area of the tool with the drilling fluid like in the use of a moving mechanical seal.

Operation—Operational Pilot Flow—All When the Pilot is in the Closed Position;

The motor [310] rotates the rotary magnetic coupling [300] which transfers the rotary motion to linear motion of the pilot valve [260] by using an anti-rotation block [290]. The mechanism of the rotary magnetic coupling [300] is immersed in oil and is protected from the drilling fluid flow by a bellows [280] and a pilot flow shield [270]. When the motor [310] moves the pilot valve [260] forward [ upward in FIG. 1] into the pilot orifice [250], the pilot fluid flow is blocked and backs up as the pilot fluid in the pilot flow exit channel [360], pilot flow inlet channel [230] and in the pilot flow upper annulus [160] all the way back to the pilot flow screen [130] which is located in the lower velocity flow area due to the larger flow area of the main flow [110] and pilot flow [100] where the pilot flow fluid pressure is higher than the fluid flow through the main orifice [180]. The pilot fluid flow [100] in the pilot flow exit channel [360] also backs up through the main valve feed channel [220] and into the main valve pressure chamber [200]. The fluid pressure in the main valve pressure chamber [200] is equal to the main flow [110] pressure, but this pressure is higher relative to the pressure of the main fluid flow in the main orifice [180] in front portion of the main valve [190]. This differential pressure between the pilot flow in the main valve pressure chamber (200) area and the main flow through the main orifice [180] into the main orifice (180) causes the main valve [190] to act like a piston and to move toward closure [still upward in FIG. 1] causing the main orifice [180] to stop the flow of the main fluid flow [110] causing the main valve [190] to stop the main fluid flow [110] through the main orifice [180].

Opening Operation

When the motor (310) moves the pilot valve [260] away [downward in FIG. 1] from the pilot orifice [250] allowing the fluid to exit the pilot exit flow [320] and pass from the pilot flow exit channel [360] relieving the higher pressure in the main valve pressure chamber [200] this causes the fluid pressure to be reduced and the fluid flow to escape. In this instance, the main fluid flow [110] is forced to flow through the main orifice [180] to push open [downward in FIG. 1] the main valve [190], thus allowing the main fluid [110] to bypass the main valve [190] and to flow unencumbered through the remainder of the tool.

Pilot Valve in the Open Position

As the main flow [110] and the pilot flow [100] enter the main flow entrance [150] and combined flow through into the flow cone area [170], by geometry [decreased cross-sectional area], the velocity of the fluid flow increases. When the fluid reaches the main orifice [180] the fluid flow velocity is increased [reducing the pressure and increasing the velocity] and the pressure of the fluid is decreased relative to the entrance flows [main area vs. the orifice area] [180]. When the pilot valve [260] is in the opened position, the main valve [190] is also in the opened position and allows the fluid to pass through the main orifice [180] and around the main valve [190], through the openings in the main valve support block [350] through the pilot valve support block [330] and subsequently into the main exit flow [340].

DETAILED DESCRIPTION

The present invention will now be described in greater detail and with reference to the accompanying drawings. With reference now to FIG. 1, the device illustrated produces pressure pulses for pulsing of the pulser within a main valve actuator assembly of the flow throttling device (FTD) in the vertical upward and downward direction using drilling fluid that flows through a tubular rental collar and an upper annulus which houses the pilot flow. There is a flow cone secured to the inner diameter of a hang off collar with major assemblies of the MWD that include a pilot flow screen assembly, a main valve actuator assembly, and a pilot actuator assembly.

To enable the pulser to move in a pulsing upward and downward direction, the passage of the main flow of the drilling fluid flows through the pilot flow screen into the main flow entrance then into the flow cone section and through the main orifice and main valve past the main valve pressure chamber, past the seals, and finally into and through the main valve support block with the flow seal guide.

At this point, the initial drilling fluid combines with the pilot exit fluid and together results in the exit flow of the main fluid. The pilot fluid flow continues flowing through the pilot flow screen and into the pilot flow screen chamber then through the pilot flow upper annulus section, the pilot flow lower annulus section and into the pilot flow inlet channel where the fluid flows upward into the main valve feed channel until it reaches the main valve pressure chamber causing upward motion of the pulser. There, the fluid flows back down the main valve feed channel through the pilot flow exit channel and through the pilot orifice and pilot valve at which point the fluid exits the pilot area where it flows over the pilot flow shield and combines with the main flow to comprise the main exit flow as it exits the pilot valve support block and flows down both sides of the rotary magnetic coupling, outside the magnetic pressure cup and eventually past the drive shaft and the motor.

In operation to accomplish the task of providing for the pilot to attain the closed position, the motor rotates the rotary magnetic coupling transfers rotary motion to linear motion of the pilot valve by using an anti-rotation block. The mechanism of the rotary magnetic coupling is protected from the fluid flow by the use of a bellows and a pilot flow shield. When the motor moves the pilot valve forward—upward into the pilot orifice—the pilot valve blocks and backs up the pilot fluid in the pilot flow exit channel, the pilot flow inlet channel, and in the pilot flow upper annulus, such that the fluid back up and reaches all the way back to the pilot flow screen (which is located in the lower velocity flow area due to the geometry of the larger flow area of the main flow and pilot flow sections such that the pilot flow fluid pressure is higher than the fluid flow through the main orifice).

The pilot fluid flow in the pilot flow exit channel also backs up through the main valve feed channel and into the main valve pressure chamber. The fluid pressure in the main valve pressure chamber is now equal to the main flow pressure but the fluid pressure is higher relative to the pressure of the main fluid flow in the main orifice in the front portion of the main valve. The differential pressure between the pilot flow and the main flow through the main orifice causes the main valve to act like a piston and moves toward closure of the main orifice (upward direction in the Figures provided), thereby causing the main valve to provide a stoppage of the flow of the main fluid flow within the main orifice.

In another embodiment, the MWD device utilizes a turbine residing near and within the proximity of a flow diverter. The flow diverter diverts drilling mud in an annular flow channel into and away from the turbine blades such that the force of the drilling mud causes the turbine blades and turbine to rotationally spin around an induction coil. The induction coil generates electrical power for operating the motor and other instrumentation mentioned previously. The motor is connected to the pilot actuator assembly via a drive shaft. The pilot actuator assembly comprises a magnetic coupling and pilot assembly. The magnetic coupling comprises outer magnets placed in direct relation to inner magnets located within the magnetic pressure cup or magnetic coupling bulkhead. The magnetic coupling translates the rotational motion of the motor, via the outer magnets to linear motion of the inner magnets via magnetic polar interaction. The linear motion of the inner magnets moves the pilot assembly, comprising the pilot shaft, and pilot valve, linearly moving the pilot into the pilot seat. This action allows for closing the pilot seat, pressurizing the flow throttling device, closing the flow throttling device orifice, thereby generating a pressure pulse. Further rotation of the motor, drive shaft, via the magnetic coupling, moves the pilot assembly and pilot away from the pilot seat, depressurizing the flow throttling device sliding pressure chamber and opening the flow throttling device and completing the pressure pulse. Identical operation of the pilot into and out of the pilot seat orifice can also be accomplished via linear to linear and also rotation to rotation motions of the outer magnets in relation to the inner magnets such that, for example, rotating the outer magnet to rotate the inner magnet to rotate a (rotating) pilot valve causing changes in the pilot pressure, thereby pushing the FTD (flow throttling device) up or down.

Unique features of the pulser include the combination of middle and lower inner flow channels, flow throttling device, bellows, and upper and lower flow connecting channels possessing angled outlet openings that helps create signals transitioning from both the sealed [closed] and unsealed (open) positions. Additional unique features include a flow cone for transitional flow and a sliding pressure chamber designed to allow for generation of the pressure pulses. The flow throttling device slides axially on a pulser guide pole being pushed by the pressure generated in the sliding pressure chamber when the pilot is in the seated position. Additional data (and increased bit rate) is generated by allowing the fluid to quickly back flow through the unique connecting channel openings when the pilot is in the open position. Bi-directional axial movement of the poppet assembly is generated by rotating the motor causing magnets to convert the rotational motion to linear motion which opens and closes the pilot valve. The signal generated provides higher data rate in comparison with conventional pulsers because of the bi-directional pulse feature. Cleaner signals are transmitted because the pulse is developed in near-laminar flow within the uniquely designed flow channels and a water hammer effect due to the small amount of time required to close the flow throttling device.

The method for generating pressure pulses in a drilling fluid flowing downward within a drill string includes starting at an initial first position wherein a pilot (that can seat within a pilot seat which resides at the bottom of the middle inner flow channel) within a lower inner flow channel is not initially engaged with the pilot seat. The pilot is held in this position with the magnetic coupling. The next step involves rotating the motor causing the magnetic fields of the outer and inner magnets to move the pilot actuator assembly thereby moving the pilot into an engaged position with the pilot seat. This motion seals a lower inner flow channel from the middle inner flow channel and forces the inner fluid into a pair of upper connecting flow channels, expanding the sliding pressure chamber, causing a flow throttling device to move up toward a middle annular flow channel and stopping before the orifice seat, thereby causing a flow restriction. The flow restriction causes a pressure pulse or pressure increase transmitted uphole. At the same time, fluid remains in the exterior of the lower connecting flow channels, thus reducing the pressure drop across the, pilot seat. This allows for minimal force requirements for holding the pilot in the closed position. In the final position, the pilot moves back to the original or first position away from the pilot orifice while allowing fluid to flow through the second set of lower connecting flow channels within the lower inner flow channel. This results in evacuating the sliding pressure chamber as fluid flows out of the chamber and back down the upper flow connecting channels into the middle inner flow channel and eventually into the lower inner flow channel. As this occurs, the flow throttling device moves in a downward direction along the same direction as the flowing drilling fluid until motionless. This decreases the FTD created pressure restriction of the main drilling fluid flow past the flow throttling device orifice completing the pulse.

An alternative embodiment includes the motor connected to a drive shaft through a mechanical device such as a worm gear, barrel cam face cam or other mechanical means for converting the rotational motion of the motor into linear motion to propel the pilot actuator assembly.

Opening Operation

When the pilot valve moves away (downward in the vertical direction) into the pilot orifice allowing the fluid to flow through the pilot exit and pass from the pilot flow exit channel causing relief of the higher pressure in the main valve pressure chamber. This allows for the pressure to be reduced and the fluid to escape the chamber. The fluid is then allowed to flow into the main fluid flow and flow through the main orifice pushing open (downward) or opening the main valve, thus allowing the main fluid to by pass the main valve and to flow unencumbered through the remainder of the tool.

When the main flow and pilot flow enters the main flow entrance and flows through into the flow cone area where the velocity of the fluid flow increases such that the fluid reaches the main orifice and the fluid flow velocity is increased (reducing the pressure and increasing the velocity of the fluid). The pressure of the fluid is decreased relative to the entrance flows (main area vs. the orifice area). When the pilot valve is in the opened position, the main valve is also in the open position and allows the fluid to pass through the main orifice and around the main valve and through the openings in the main valve support block allowing for the fluid to flow through the opening of the pilot and through the pilot valve support block. Subsequently the fluid flows into the main exit flow channel.

With reference now to FIG. 1, the device illustrated produces pressure pulses in drilling fluid flowing through a tubular drill collar and upper annular drill collar flow channel. The flow cone is secured to the inner diameter of the drill collar. The centralizer secures the lower portion of the pulse generating device and is comprised of a non-magnetic, rigid, wear resistant material with outer flow channels.

These conditions provide generation of pulses as the flow throttling device reaches both the closed and opened positions. The present invention allows for several sized FTD's to be placed in a drilling collar, thereby allowing for different flow restrictions and/or frequencies which will cause an exponential increase in the data rate that can be transmitted up hole.

Positioning of the main valve actuator assembly within the drill collar and utilizing the flow cone significantly decreases the turbulence of the fluid and provides essentially all laminar fluid flow. The linear motion of the flow throttling device axially is both up and down (along a vertical axial and radial direction without the use of a guide pole).

Conventional pulsers require adjustments to provide a consistent pulse at different pressures and flow rates. The signal provided in conventional technology is by a pulse that can be received up hole by use of a pressure transducer that is able to differentiate pressure pulses (generated downhole). These uphole pulses are then converted into useful signals providing information for the oilfield operator, such as gamma ray counts per second, azimuth, etc. Another advantage of the present invention is the ability to create a clean [essentially free of noise] pulse signal that is essentially independent of the fluid flow rate or pressure within the drill collar. The present invention thereby allows for pulses of varying amplitudes (in pressure) and frequencies to increase the bit rate.

While the present invention has been described herein with reference to a specific exemplary embodiment thereof, it will be evident that various modifications and changes may be made thereto without departing from the broader spirit and scope of the invention as set forth in the appended claims. The specification and drawings included herein are, accordingly to be regarded in an illustrative rather than in a restrictive sense.

What is claimed is:

1. An apparatus for generating pressure pulses in a drilling fluid, flowing within a drill string, comprising: a flow throttling device longitudinally and axially positioned within the center of a main valve actuator assembly, said main valve actuator assembly comprising a main valve pressure chamber, a magnetic cup encompassing a rotary magnetic coupling containing at least one magnet adjacent to a drive shaft wherein said magnetic cup is located within a pilot actuator assembly, said assembly including a pilot orifice with a pilot valve, a pilot flow shield, a bellows and an anti-rotation block such that passage of said drilling fluid flows through a pilot flow screen and into a main flow entrance into a flow cone through a main orifice and into a main valve past a main valve pressure chamber past a set of seals and through a main valve support block then through a flow seal guide where said fluid combines with a pilot exit fluid that flows toward a main exit flow such that as said fluid becomes a pilot fluid subsequently flowing through said pilot flow screen into said pilot flow screen chamber through a pilot flow upper annulus, through a pilot flow lower annulus and into a pilot flow inlet channel, wherein said pilot fluid then flows up into said main valve feed channel until it reaches said main valve pressure chamber such that said pilot fluid flows back down said main valve feed channel through said pilot flow exit channel through said pilot orifice and said pilot valve to exit said pilot valve and said pilot fluid then flows over said pilot flow shield such that it combines with said main flow becoming the main exit flow fluid, said main exit flow fluid then exits said pilot valve support block and flows on either side of said magnetic pressure cup including said rotary magnetic coupling and then finally past a drive shaft and motor such that said fluid causes one or more flow throttling devices to generate large, rapid controllable pulses thereby allowing transmission of well developed signals easily distinguished from noise resulting from other vibrations due to nearby equipment that is within said borehole or exterior to said borehole, said signals also capable of providing predetermined height, width and shape.

2. The apparatus of claim 1, wherein said apparatus also utilizes a turbine residing near and within proximity of a flow diverter that diverts drilling mud in said annular flow channel into and away from turbine blades such that the force of the drilling mud causes said turbine blades and said turbine to rotationally spin around a coil assembly.

3. The apparatus of claim 1, wherein said coil assembly generates electrical power for operating a motor and other operating equipment useful for instrumentation, said motor comprising a drive shaft centrally located between said motor and a magnetic pressure coupling wherein said motor and said coupling are mechanically coupled such that said motor rotates said magnetic pressure coupling outer magnets and bi-directionally moves said pilot actuator assembly.

4. The apparatus of claim 1, wherein said apparatus for generating pulses includes a pilot, a pilot bellows, a flow throttling device, and a sliding pressure chamber, such that said flow throttling device and said pilot are capable of bi-directional axial movement without a guide pole.

5. The apparatus of claim 1, wherein a magnetic coupling is formed by a location external and internal to said magnetic pressure cup where outer magnets are placed in relation to inner magnets, said inner magnets located in a position inside said magnetic pressure cup, said coupling allowing for translating rotational motion of said motor and outer magnets to linear motion of said inner magnets via a magnetic polar interaction, wherein linear motion of said inner magnets move said pilot actuator assembly, thereby linearly moving a pilot into a pilot seat, closing a pilot seat orifice, lifting a flow throttling device into a flow throttling orifice and thereby generating a pulse wherein further rotation of said motor drive shaft, and outer magnets move said pilot actuator assembly and said pilot away from said pilot seat causing said flow throttling device to move away from said flow throttling orifice, thereby ending a positive pulse.

6. The apparatus of claim 1, wherein said motor is connected to a drive shaft through a mechanical device including mechanical means including a worm gear, or barrel cam face cam for converting the rotational motion of said motor into linear motion to propel said pilot actuator assembly.

7. The apparatus of claim 1, wherein said apparatus includes a path for said pilot and said flow throttling device for operation in a bi-directional axial movement.

8. The apparatus of claim 1, wherein said pilot actuator assembly is comprised of a rear pilot shaft, front pilot shaft, pilot shield, and pilot.

9. The apparatus of claim 1 wherein differential pressure is maximized with the use of said flow cone in that said cone provides for increasing the velocity of said drilling fluid through said main valve actuator assembly, thereby greatly enhancing the pressure differential and controllability of energy pulses created by engagement or disengagement of said pilot from a pilot seat.

10. The apparatus of claim 1, wherein said motor may be synchronous, asynchronous or stepper and is activated to fully rotate or to rotate incrementally in various degrees depending on wellbore conditions or the observed signal intensity and/or duration of drilling.

11. The apparatus of claim 1, wherein said turbine resides within said annular flow channel of a flow guide and wherein said annular flow channel has diverting vanes that direct flow of drilling mud through and around a surface of said turbine.

12. The apparatus of claim 1, wherein said turbine includes a turbine shroud comprising turbine magnets that rotate with the motion of said turbine around said coil assembly causing electrical power to be generated and allowing for decreased battery requirements, a decrease in cost of said battery, decreased operational downtime, and subsequently decreased cost of said apparatus.

13. The apparatus of claim 1, wherein energy consumption may also be further reduced by pre-filling the bellows chamber with a lubricating fluid, gel or paste.

14. The apparatus of claim 1, wherein said turbine blades outside diameters around a pulser housing is smaller than a flow guide extension inner diameter, thereby allowing said turbine to be removed concurrently with said pulser housing.

15. The apparatus of claim 1, wherein said apparatus for generating pulses includes allowing a bellows to move linearly, concurrent with said pilot actuator assembly, wherein the design of said bellows interacts with said pilot actuator assembly and a bellows chamber allowing said bellows to conform to the space constraints of said bellows chamber providing flexible sealing without said bellows being displaced by the pressure differential created by said drilling fluid.

16. The apparatus of claim 1, wherein said bellows may include a double loop configuration designed for said flexible sealing thereby requiring less energy consumption during displacement of said bellows.

17. The apparatus of claim 1, wherein said pulse in said drilling mud is sensed by said instrumentation located uphole and wherein said pulse is communicated with wireless devices, to a computer with a programmable controller for interpretation.

18. A method for generating pressure pulses in a drilling fluid, flowing within a drill string, comprising:

a flow throttling device longitudinally and axially positioned within the center of a main valve actuator assembly, said main valve actuator assembly comprising a main valve pressure chamber, a magnetic cup encompassing a rotary magnetic coupling containing at least one magnet adjacent to a drive shaft wherein said magnetic cup is located within a pilot actuator assembly, said assembly including a pilot orifice with a pilot valve, a pilot flow shield, a bellows and an anti-rotation block such that passage of said drilling fluid flows through a pilot flow screen and into a main flow entrance into a flow cone through a main orifice and into a main valve past a main valve pressure chamber past a set of seals and through a main valve support block then through a flow seal guide where said fluid combines with a pilot exit fluid that flows toward a main exit flow such that as said fluid becomes a pilot fluid subsequently flowing through said pilot flow screen into said pilot flow screen chamber through a pilot flow upper annulus, through a pilot flow lower annulus and into a pilot flow inlet channel, wherein said pilot fluid then flows up into said main valve feed channel until it reaches said main valve pressure chamber such that said pilot fluid flows back down said main valve feed channel through said pilot flow exit channel through said pilot orifice and said pilot valve to exit said pilot valve and said pilot fluid then flows over said pilot flow shield such that it combines with said main flow becoming the main exit flow fluid, said main exit flow fluid then exits said pilot valve support block and flows on either side of said magnetic pressure cup including said rotary magnetic coupling and then finally past a drive shaft and motor such that said fluid causes one or more flow throttling devices to generate large, rapid controllable pulses thereby allowing transmission of well developed signals easily distinguished from noise resulting from other vibrations due to nearby equipment that is within said borehole or exterior to said borehole, said signals also capable of providing predetermined height, width and shape.

19. The method of claim 18, wherein said coil assembly generates electrical power for operating a motor and other operating equipment useful for instrumentation, said motor comprising a drive shaft centrally located between said motor and a magnetic pressure coupling wherein said motor and said coupling are mechanically coupled such that said motor rotates or linearly moves said magnetic pressure coupling outer magnets and moves said pilot actuator assembly, wherein said assembly opens and closes either a linear or rotational pilot valve.

20. The method of claim 18, wherein a magnetic coupling is formed by a location external and internal to said magnetic pressure cup where outer magnets are placed in relation to inner magnets, said inner magnets located in a position inside said magnetic pressure cup, said coupling allowing for translating rotational motion of said motor and outer magnets to linear motion of said inner magnets via a magnetic polar interaction, wherein linear motion of said inner magnets move said pilot actuator assembly, thereby linearly moving a pilot into a pilot seat, closing a pilot seat orifice, lifting a flow throttling device into a flow throttling orifice and thereby generating a pulse wherein further rotation of said motor drive shaft, and outer magnets move said pilot actuator assembly and said pilot away from said pilot seat causing said flow throttling device to move into said flow throttling orifice, thereby generating another pulse.

21. The method of claim 18, wherein said motor is connected to a drive shaft through a mechanical device including mechanical means including a worm gear or barrel cam face cam for converting the rotational motion of said motor into linear motion to propel said pilot actuator assembly.

22. The method of claim 18, wherein said apparatus includes a path for said pilot and said flow throttling device for operation in a bi-directional axial movement.

23. The method of claim 18, wherein said pilot actuator assembly is comprised of a rear pilot shaft, front pilot shaft, pilot shield and a pilot.

24. The method of claim 18, wherein differential pressure is minimal in that a slight force acting on a small cross-sectional area of a pilot seat defines a pressure that is required to either engage or disengage said pilot.

25. The method of claim 18, wherein said motor may be synchronous, asynchronous, or stepper and is activated to fully rotate or to rotate incrementally in various degrees depending on wellbore conditions or the observed signal intensity and/or duration of drilling.

26. The method of claim 18, wherein said turbine resides within said annular flow channel of a flow guide and wherein said annular flow channel has diverting vanes that direct flow of drilling mud through and around a surface of said turbine.

27. The method of claim 18, wherein said turbine includes a turbine shroud comprising turbine magnets that rotate with the motion of said turbine around said coil assembly causing electrical power to be generated and allowing for decreased battery requirements, a decrease in cost of said battery, decreased operational downtime, and subsequently decreased cost of said apparatus.

28. The method of claim 18, wherein energy consumption may also be further reduced by pre-filling a bellows chamber with a lubricating fluid, gel or paste.

29. The method of claim 18, wherein said turbine blades outside diameters around a pulser housing is smaller than a flow guide extension inner diameter, thereby allowing said turbine to be removed concurrently with said pulser housing.

30. The method of claim 18, wherein said apparatus for generating pulses includes allowing a bellows to move linearly, concurrent with said pilot actuator assembly, wherein the design of said bellows interacts with said pilot actuator assembly and a bellows chamber allowing said bellows to conform to the space constraints of said bellows chamber providing flexible sealing without said bellows being displaced by the pressure differential created by said drilling fluid.

31. The method of claim 18, wherein said bellows may include a double loop configuration designed for said flexible sealing thereby requiring less energy consumption during displacement of said bellows.

32. The method of claim 18, wherein said pulse in said drilling mud is sensed by said instrumentation located within an uphole device and wherein said pulse is communicated with wireless devices, to a computer with a programmable controller for interpretation.

33. A system comprising two or more apparatuses for generating pressure pulses in a drilling fluid, flowing within a drill string, comprising:

two or more flow throttling devices longitudinally and axially positioned within the center of a main valve actuator assembly, said main valve actuator assembly comprising a main valve pressure chamber, a magnetic cup encompassing a rotary magnetic coupling containing at least one magnet adjacent to a drive shaft wherein said magnetic cup is located within a pilot actuator assembly, said assembly including a pilot orifice with a pilot valve, a pilot flow shield, a bellows and an anti-rotation block such that passage of said drilling fluid flows through a pilot flow screen and into a main flow entrance into a flow cone through a main orifice and into a main valve past a main valve pressure chamber past a set of seals and through a main valve support block then through a flow seal guide where said fluid combines with a pilot exit fluid that flows toward a main exit flow such that as said fluid becomes a pilot fluid subsequently flowing through said pilot flow screen into said pilot flow screen chamber through a pilot flow upper annulus, through a pilot flow lower annulus and into a pilot flow inlet channel, wherein said pilot fluid then flows up into said main valve feed channel until it reaches said main valve pressure chamber such that said pilot fluid flows back down said main valve feed channel through said pilot flow exit channel through said pilot orifice and said pilot valve to exit said pilot valve and said pilot fluid then flows over said pilot flow shield such that it combines with said main flow becoming the main exit flow fluid, said main exit flow fluid then exits said pilot valve support block and flows on either side of said magnetic pressure cup including said rotary magnetic coupling and then finally past a drive shaft and motor such that said fluid causes one or more flow throttling devices to generate large, rapid controllable pulses thereby allowing transmission of well developed signals easily distinguished from noise resulting from other vibrations due to nearby equipment that is within said borehole or exterior to said borehole, said signals also capable of providing predetermined height, width and shape.

34. A system for generating pressure pulses in a drilling fluid, flowing within a drill string, comprising: a flow throttling device longitudinally and axially positioned within the center of a main valve actuator assembly, said main valve actuator assembly comprising a main valve pressure chamber, a magnetic cup encompassing a rotary magnetic coupling containing at least one magnet adjacent to a drive shaft wherein said magnetic cup is located within a pilot actuator assembly, said assembly including a pilot orifice with a pilot valve, a pilot flow shield, a bellows and an anti-rotation block such that passage of said drilling fluid flows through a pilot flow screen and into a main flow entrance into a flow cone through a main orifice and into a main valve past a main valve pressure chamber past a set of seals and through a main valve support block then through a flow seal guide where said fluid combines with a pilot exit fluid that flows toward a main exit flow such that as said fluid becomes a pilot fluid subsequently flowing through said pilot flow screen into said pilot flow screen chamber through a pilot flow upper annulus, through a pilot flow lower annulus and into a pilot flow inlet channel, wherein said pilot fluid then flows up into said main valve feed channel until it reaches said main valve pressure chamber such that said pilot fluid flows back down said main valve feed channel through said pilot flow exit channel through said pilot orifice and said pilot valve to exit said pilot valve and said pilot fluid then flows over said pilot flow shield such that it combines with said main flow becoming the main exit flow fluid, said main exit flow fluid then exits said pilot valve support block and flows on either side of said magnetic pressure cup including said rotary magnetic coupling and then finally past a drive shaft and motor such that said fluid causes one or more flow throttling devices to generate large, rapid controllable pulses thereby allowing transmission of well developed signals easily distinguished from noise resulting from other vibrations due to nearby equipment that is within said borehole or exterior to said borehole, said signals also capable of providing predetermined height, width and shape.

35. The system of claim 34, wherein said coil assembly generates electrical power for operating a motor and other operating equipment useful for instrumentation, said motor comprising a drive shaft centrally located between said motor and a magnetic pressure coupling wherein said motor and said coupling are mechanically coupled such that said motor rotates said magnetic pressure coupling outer magnets and moves said pilot actuator assembly.

36. The system of claim 34, wherein a magnetic coupling is formed by a location external and internal to said magnetic pressure cup where outer magnets are placed in relation to inner magnets, said inner magnets located in a position inside said magnetic pressure cup, said coupling allowing for translating rotational motion of said motor, magnetic pressure cup and outer magnets to linear motion of said inner magnets via a magnetic polar interaction, wherein linear motion of said inner magnets move said pilot actuator assembly, thereby linearly moving a pilot into a pilot seat, closing a pilot seat orifice, lifting a flow throttling device into a flow throttling orifice and thereby generating a pulse wherein further rotation of said motor drive shaft, magnetic pressure cup, and outer magnets move said pilot actuator assembly and said pilot away from said pilot seat causing said flow throttling device to move into said flow throttling orifice, thereby generating a negative pulse.

37. The system of claim 34, wherein said motor is connected to a drive shaft through a mechanical device including a mechanical means including a worm gear or barrel cam face cam for converting the rotational motion of said motor into linear motion to propel said pilot actuator assembly.

38. The system of claim 34, wherein said apparatus includes a pilot, a pilot bellows, a flow throttling device, and a sliding pressure chamber, such that said flow throttling device and said pilot are capable of bi-directional axial movement without a guide pole.

39. The system of claim 34, wherein said pilot actuator assembly is comprised of a rear pilot shaft, front pilot shaft, pilot shield, and pilot.

40. The system of claim 34, wherein differential pressure is minimal in that a slight force acting on a small cross-sectional area of a pilot seat defines a pressure that is required to either engage or disengage said pilot.

41. The system of claim 34, wherein said motor may be synchronous, asynchronous, or stepper and is activated to fully rotate or to rotate incrementally in various degrees depending on wellbore conditions or the observed signal intensity and/or duration of drilling.

42. The system of claim 34, wherein said turbine resides within said annular flow channel of a flow guide and wherein said annular flow channel has diverting vanes that direct flow of drilling mud through and around a surface of said turbine.

43. The system of claim 42, wherein said turbine includes a turbine shroud comprising turbine magnets that rotate with the motion of said turbine around said coil assembly causing electrical power to be generated and allowing for decreased energy requirements for batteries, a decrease in cost of said batteries, decreased operational downtime, and subsequently decreased cost of said apparatus.

44. The system of claim 34, wherein energy consumption may also be further reduced by pre-filling a bellows chamber with a lubricating fluid, gel or paste.

45. The system of claim 34, wherein said turbine blades outside diameter is smaller than a flow guide extension inner diameter, thereby allowing said turbine to be removed concurrently with said pulser housing.

46. The system of claim 34, wherein said apparatus for generating pulses includes allowing a bellows to move linearly, concurrent with said pilot actuator assembly, wherein the design of said bellows interacts with said pilot actuator assembly and a bellows chamber allowing said bellows to conform to the space constraints of said bellows chamber providing flexible sealing without said bellows being displaced by the pressure differential created by said drilling fluid.

47. The system of claim 34, wherein said bellows may include a double loop configuration designed for said flexible sealing thereby requiring less energy consumption during displacement of said bellows.

* * * * *